US010407890B2

(12) United States Patent
Kashirajima et al.

(10) Patent No.: US 10,407,890 B2
(45) Date of Patent: Sep. 10, 2019

(54) FLUSH TOILET BOWL

(71) Applicant: TOTO LTD., Kitakyushu-shi, Fukuoka (JP)

(72) Inventors: Shu Kashirajima, Fukuoka (JP); Yukihiro Sawayama, Fukuoka (JP)

(73) Assignee: TOTO LTD., Kitakyushu-Shi (JP)

( * ) Notice: Subject to any disclaimer, the term of this patent is extended or adjusted under 35 U.S.C. 154(b) by 0 days.

(21) Appl. No.: 15/830,113

(22) Filed: Dec. 4, 2017

(65) Prior Publication Data

US 2018/0155912 A1 Jun. 7, 2018

(30) Foreign Application Priority Data

Dec. 7, 2016 (JP) ..... 2016-237777

(51) Int. Cl.
*E03D 11/08* (2006.01)
*E03D 1/30* (2006.01)
*E03D 5/01* (2006.01)

(52) U.S. Cl.
CPC ..... *E03D 11/08* (2013.01); *E03D 1/30* (2013.01); *E03D 5/01* (2013.01)

(58) Field of Classification Search
CPC ..... E03D 1/30; E03D 11/30
USPC ..... 4/420, 506
See application file for complete search history.

(56) References Cited

U.S. PATENT DOCUMENTS

2014/0130246 A1* 5/2014 Wu ..... E03D 11/02 4/420
2016/0138255 A1* 5/2016 Kitamura ..... E03D 11/08 4/420

FOREIGN PATENT DOCUMENTS

JP 2012-207504 10/2012
JP 2016-084596 5/2016

* cited by examiner

*Primary Examiner* — Lauren A Crane
(74) *Attorney, Agent, or Firm* — Amin, Turocy & Watson LLP

(57) ABSTRACT

A flush toilet bowl includes a bowl part, a rim nozzle, and a rim water spout part. The bowl part has a rim part on an upper edge of a receiving surface with a bowl shape. The rim nozzle is provided on a rear part of the bowl part and spouts flush water. The rim water spout part is provided on the rim part and spouts flush water that is spouted from the rim nozzle toward the receiving surface. The rim water spout part includes a rim water guide channel that is formed inside the rim part and guides flush water that is spouted from the rim nozzle and a rim water spout port that is formed to be continuous with the rim water guide channel and in a front side region of the bowl part. The rim nozzle spouts flush water upward in the rim water guide channel.

4 Claims, 14 Drawing Sheets

FLUSH TOILET BOWL

CROSS-REFERENCE TO RELATED APPLICATION

The present application claims priority to and incorporates by reference the entire contents of Japanese Patent Application No. 2016-237777 filed in Japan on Dec. 7, 2016.

FIELD

An embodiment of the disclosure relates to a flush toilet bowl.

BACKGROUND

Conventionally, a flush toilet bowl that is washed by flush water that is supplied from a flush water source may include a rim nozzle and a rim water spout part. A rim nozzle spouts flush water from a flush water source to a rim water spout part. A rim water spout part is provided on a rim part that is formed on an upper edge of a waste receiving surface that receives waste, and includes a rim water guide channel and a rim water spout port.

A rim water guide channel is formed inside a rim part, is formed in accordance with a shape of the rim part, and guides flush water that is spouted from a rim nozzle. A rim water spout part is formed so as to be continuous with a rim water guide channel, is an exit opening for flush water, and spouts flush water to a waste receiving surface.

In such a flush toilet bowl, for example, abnormal noise such as explosive noise of air or mixing noise of air may be generated at a time of spout of flush water from a rim water spout part (rim water spout port). Accordingly, for example, a flush toilet bowl has been known where a plurality of small holes is formed on a rim nozzle, a space part that is defined by a wall that includes an inner wall where flush water that is spouted from the plurality of small holes on the rim nozzle collides therewith is formed on a rim water guide channel, and flush water from the plurality of small holes collides with the inner wall to fractionize air finely and thereby suppress abnormal noise that is caused by air (see, for example, Japanese Patent Application Publication No. 2008-303616).

Meanwhile, for a conventional flush toilet bowl as described above, it is possible to consider that a rim water spout port is arranged on a rim part in a region on a front side (front side region) with respect to a half of a waste receiving surface in order to cause a user to be difficult to view the rim water spout port, that is, in order to improve a design of a toilet, or in order to improve a washability of flush water on a waste receiving surface.

However, as a rim water spout port is arranged in a front side region of a waste receiving surface, a problem occurs in that a rim water guide channel is long and thereby an amount of air in the rim water guide channel increases so that abnormal noise that is caused by air is readily generated. That is, a conventional flush toilet bowl as described above has room for improvement in quietness thereof.

SUMMARY

It is an object of the present invention to at least partially solve a problem in a conventional technology.

A flush toilet bowl according to an embodiment includes a bowl part that is provided in such a manner that a rim part is formed on an upper edge of a receiving surface with a bowl shape, a rim nozzle that is provided on a rear part of the bowl part and spouts flush water that is supplied from a flush water source, and a rim water spout part that is provided on the rim part, spouts flush water that is spouted from the rim nozzle, toward the receiving surface, and causes flush water to swirl on the receiving surface, wherein the rim water spout part includes a rim water guide channel that is formed inside the rim part and guides flush water that is spouted from the rim nozzle, and a rim water spout port that is formed to be continuous with the rim water guide channel, is formed in a front side region of the bowl part, and spouts flush water that is guided by the rim water guide channel, toward the receiving surface, and the rim nozzle is formed in such a manner that flush water is spouted upward in the rim water guide channel.

BRIEF DESCRIPTION OF DRAWINGS

The above and other objects, features, advantages and technical and industrial significance of this invention will be better understood by reading the following detailed description of presently preferred embodiments of the invention, when considered in connection with the accompanying drawings, wherein.

DESCRIPTION OF EMBODIMENT

Hereinafter, an embodiment of a flush toilet bowl as disclosed in the present application will be described in detail, with reference to the accompanying drawings. Additionally, this invention is not limited by an embodiment as illustrated below.

General Configuration of Flush Toilet Bowl

Figure 1:
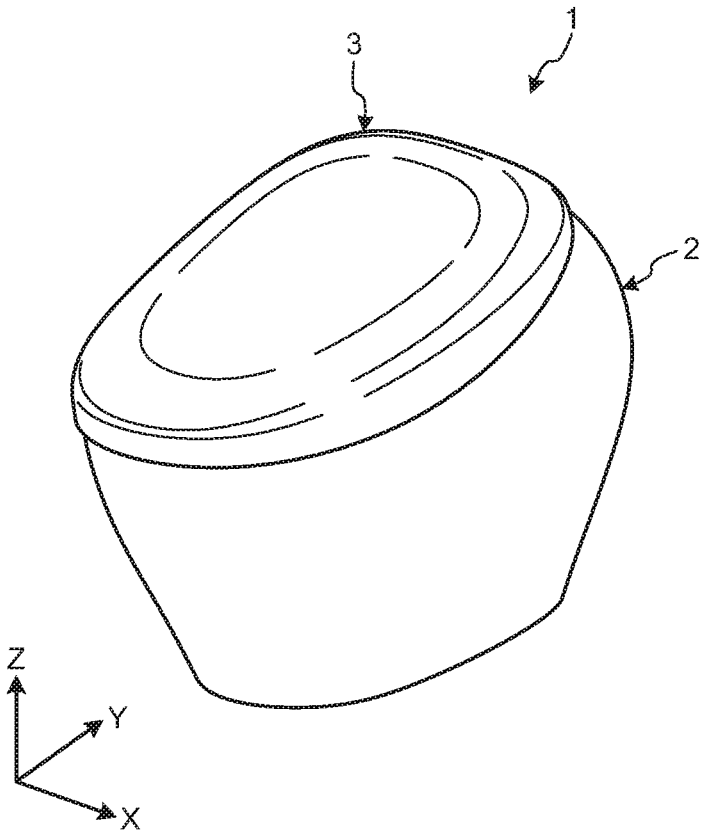
FIG. 1 is a perspective view of a flush toilet howl according to an embodiment.
Figure 2:
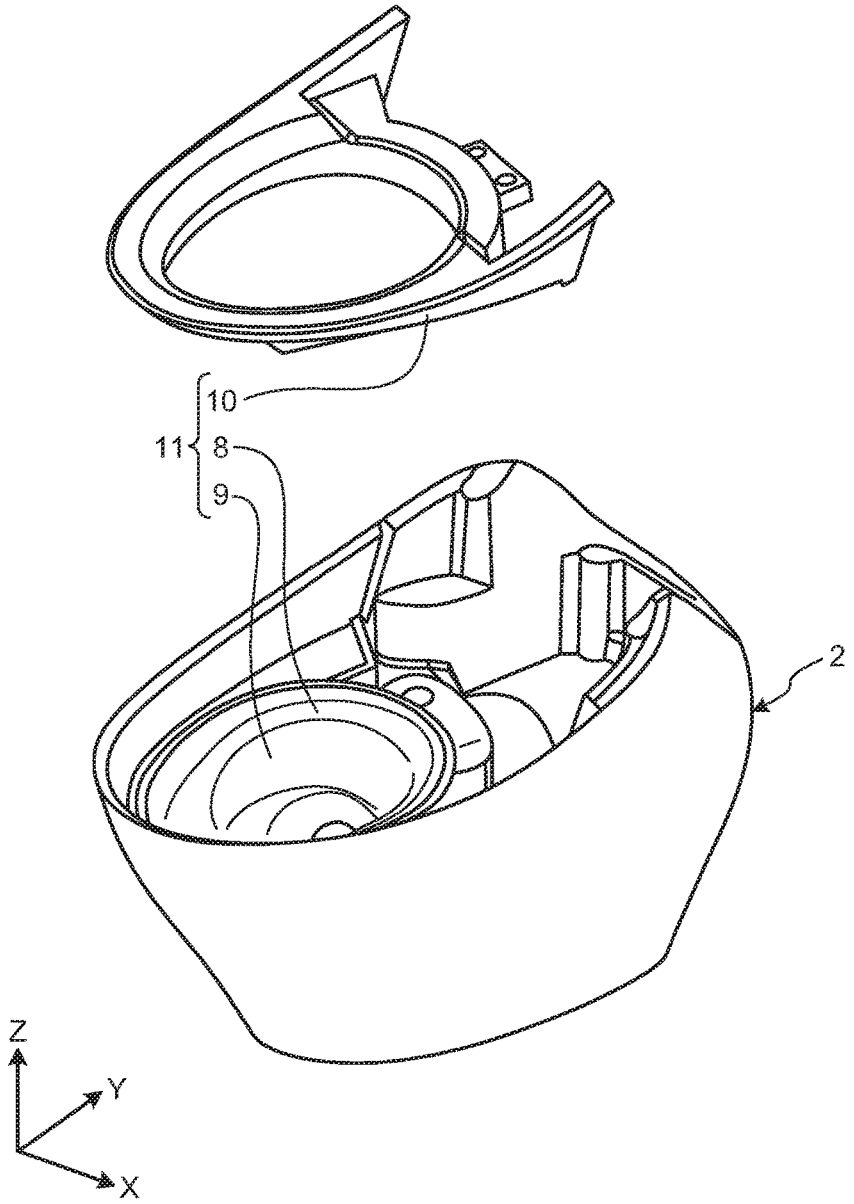
FIG. 2 is an exploded perspective view of a toilet body of a flush toilet bowl according to an embodiment.

First, a general configuration of a flush toilet bowl 1 according to an embodiment will be described with reference to FIG. 1 to FIG. 5. FIG. 1 is a perspective view of the flush toilet bowl 1 according to an embodiment. FIG. 2 is an exploded perspective view of a toilet body 2 of the flush toilet bowl 1 according to an embodiment. Additionally, FIG. 1 illustrates the flush toilet bowl 1 in a state where a toilet lid 3 and a toilet seat 4 (see FIG. 3) are closed, and FIG. 2 illustrates the toilet body 2.

Figure 3:
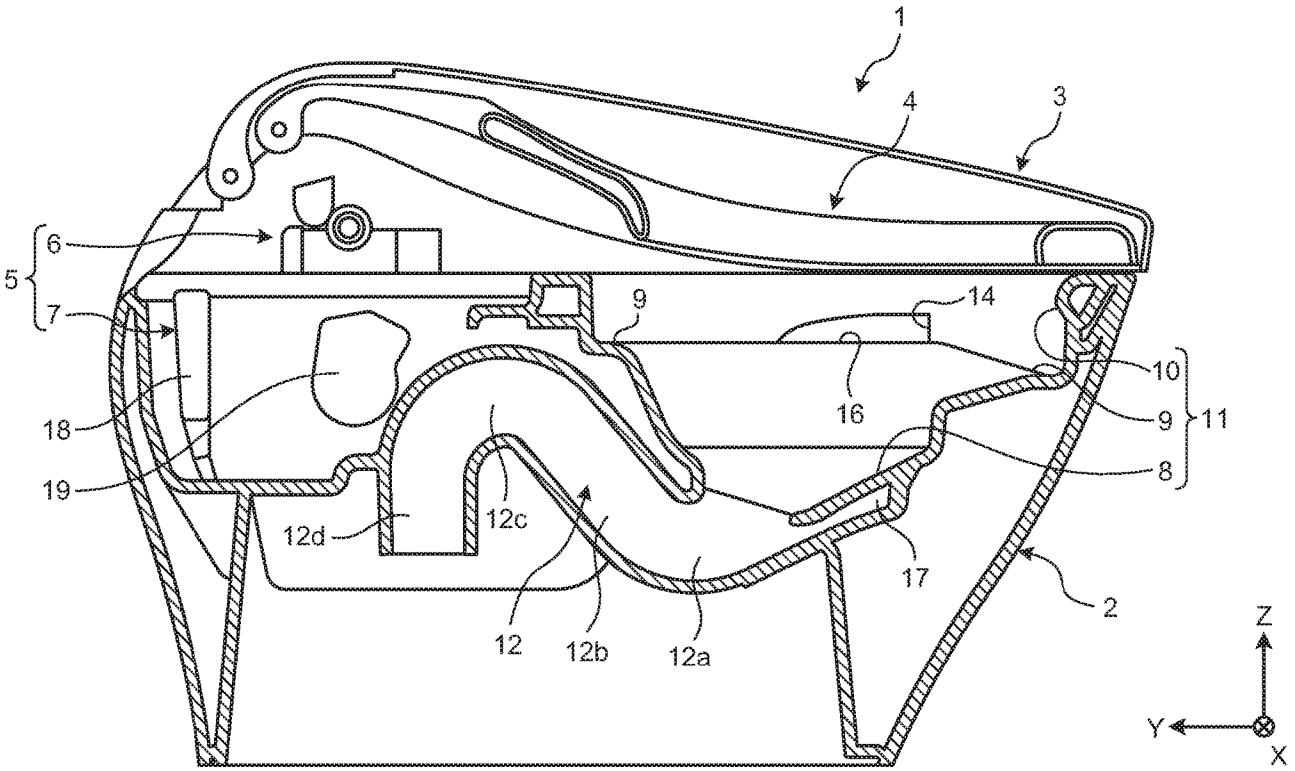
FIG. 3 is a left-side cross-sectional view of a flush toilet bowl according to an embodiment.
Figure 4:
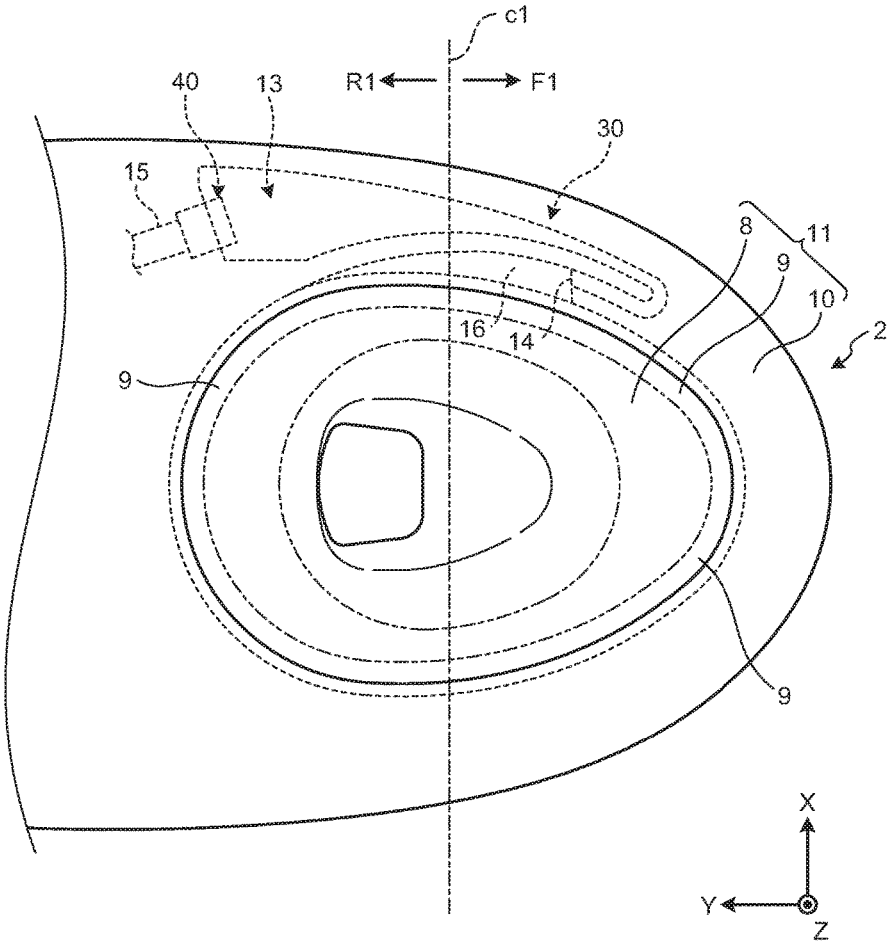
FIG. 4 is a plan view of a toilet body of a flush toilet bowl according to an embodiment.
Figure 5:
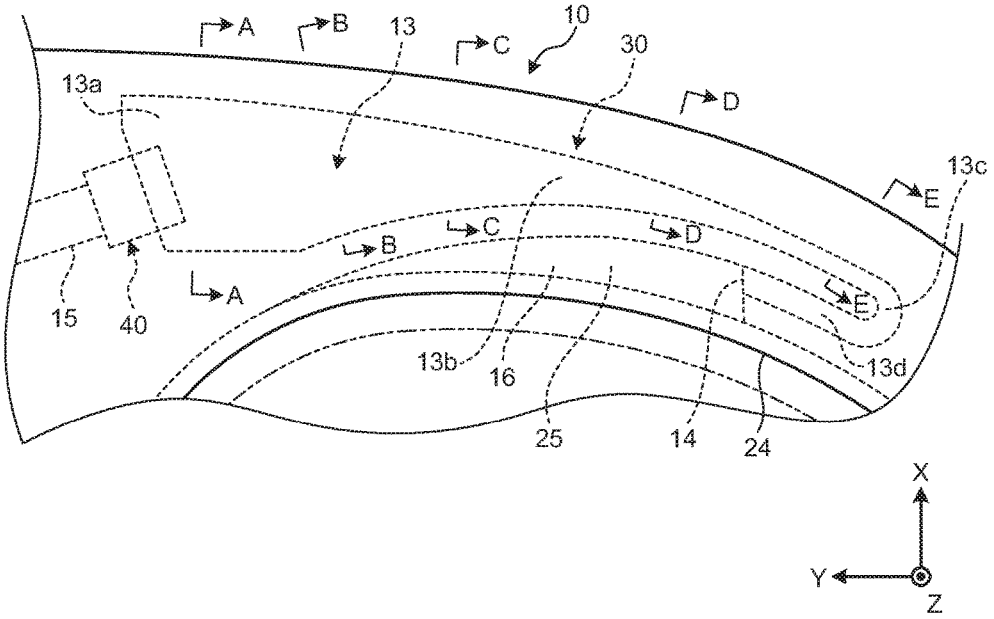
FIG. 5 is an enlarged plan view of a toilet body of a flush toilet bowl according to an embodiment.

FIG. 3 is a left-side cross-sectional view of the flush toilet bowl 1 according to an embodiment. FIG. 4 is a plan view of the toilet body 2 of the flush toilet bowl 1 according to an embodiment. FIG. 5 is an enlarged plan view of the toilet body 2 of the flush toilet bowl 1 according to an embodiment. Additionally, FIG. 5 illustrates a planner surface of a rim part 10.

Furthermore, FIG. 1 to FIG. 5 illustrate a three-dimensional and orthogonal coordinate system that includes a Z-axis where a vertically upward direction is a positive direction, for providing a clear explanation. Such an orthogonal coordinate system may also be illustrated in another diagram. Furthermore, such an orthogonal system defines a positive direction of a Y-axis as a front side and defines a positive direction of an X-axis, a negative direction of the X-axis, and a negative direction of a Z-axis as a left side, a right side, and a top side (that may also be referred to as an "upper side"), respectively. Accordingly, directions of an X-axis, directions of a Y-axis, and directions of a Z-axis may be referred to as leftward and rightward directions, frontward and backward directions, and upward and downward directions, respectively, in the following description(s).

Furthermore, although FIG. 1 to FIG. 5 illustrate the flush toilet bowl 1 that is a floor-mounted type, this is not limiting, and for example, a wall-hung type may be provided. As illustrated in FIG. 1 to FIG. 3, the flush toilet bowl 1 includes the toilet body 2, the toilet lid 3, the toilet seat 4, and a functional part 5. The toilet body (that will be referred to as a "toilet" below) 2 is made of, for example, a ceramic. The toilet lid 3 is provided rotatably in upward and downward directions and opens or closes on an upper side of the toilet 2. The toilet seat 4 is provided on an upper side of the toilet 2 and rotatably in upward and downward directions.

As illustrated in FIG. 3, the functional part 5 is provided on a rear part of the toilet 2. The functional part 5 includes a sanitary washing system functional part 6 and a water supply system functional part 7. The sanitary washing system functional part 6 is provided on a rear part of the toilet 2 and has a function for washing of a private part of a user. The water supply system functional part 7 is provided so as to be adjacent to the sanitary washing system functional part 6 on a rear part of the toilet 2 and has a function for water supply to the toilet 2.

As illustrated in FIG. 2 and FIG. 3, the toilet 2 includes a bowl part 11. The bowl part 11 includes a receiving surface 8, a shelf surface 9, and the rim part 10. The receiving surface (that will be referred to as a "waste receiving surface" below) 8 is formed into a bowl shape and receives waste. The rim part 10 is formed so as to stand on the shelf surface 9 that is provided on an upper edge of the waste receiving surface 8. As illustrated in FIG. 3, the toilet 2 is provided in such a manner that an entrance part 12*a* is connected to a lower part of the bowl part 11, and includes a drainage water trap pipeline 12 that is a water drainage path for spouting waste in the bowl part 11.

As illustrated in FIG. 4, the bowl part 11 includes a front side region F1 that is provided on a front side with respect to a center line c1 that bisects a plan view thereof in frontward and backward directions and extends in leftward and rightward directions, and a back side region R1 that is provided on a back side. A rim water guide channel 13 that is a part of a rim water spout part 30 that will be described later is formed inside the rim part 10 on one of left and right sides in the front side region F1 of the bowl part 11, that is, the rim part 10 on the right side in the front side region F1 of the bowl part 11 when the toilet 2 is viewed from a front side. Furthermore, a rim water spout port 14 that is a part of the rim water spout part 30 is formed at a downstream end of the rim water guide channel 13.

Furthermore, as illustrated in FIG. 4, a water guide pipe 15 that is a water guide channel that supplies flush water that is supplied from a (non-illustrated) water supply that is a flush water source to the rim water guide channel 13 is connected to an upstream side of the rim water guide channel 13. Furthermore, the toilet 2 includes a rim nozzle 40 that is connected to a front end of the water guide pipe 15 and arranged at an entrance part 13*a* of the rim water guide channel 13. For example, the water guide pipe 15 is directly coupled to a water supply that is a flush water source, on an upstream side. Flush water that is supplied from the water guide pipe 15 into the rim water guide channel 13 by utilizing a water supply pressure of a water supply is guided forward in the rim water guide channel 13, bends inward and backward, and is guided to the rim water spout port 14 on a downstream side.

Flush water that is guided to the rim water spout port 14 is spouted backward (which is referred to as "rim water spout"), passes through a passing water channel 16 that will be described later and is formed near a downstream side of the rim water spout port 14, and swirls in the bowl part 11, so that a swirling flow of flush water is formed in the bowl part 11. Additionally, the rim water spout port 14 is only a water spout port that is provided on the rim part 10 and spouts flush water to form a swirling flow thereof in the bowl part 11.

Additionally, although an example where the rim water guide channel 13 and the rim water spout port 14 that are provided for the rim water spout part 30 are formed inside the rim part 10 on a right side in the front side region F1 of the bowl part 11 when the toilet 2 is viewed from a front side has been described in the flush toilet bowl 1 according to the present embodiment, this is not limiting, and for example, the rim water spout port 14 may be formed in the rim part 10 on a left side in the front side region F1 of the bowl part 11 when the toilet 2 is viewed from a front side, so as to rim-spout water backward.

Furthermore, the rim water guide channel 13 and the rim water spout port 14 that are provided for the rim water spout part 30 may be formed integrally with the toilet 2, for example, by processing a pottery or may be formed of a resin or the like separately from the toilet 2 and installed in the toilet 2.

Furthermore, as illustrated in FIG. 3, a jet water spout port 17 is formed on a lower part of the bowl part 11 so as to face an entrance part 12*a* of the drainage water trap pipeline 12. The jet water spout port 17 spouts flush water that is pressurized by the water supply system functional part 7 (which is referred to as "jet water spout"). Specifically, the water supply system functional part 7 includes a water storage tank 18 that stores flush water and a pressurization pump 19 that pressurizes flush water that is stored in the water storage tank 18, and the jet water spout port 17 jet-spouts such flush water.

Furthermore, flush water that is spouted from the jet water spout port 17 flows from the entrance part 12*a* of the drainage water trap pipeline 12 into a rise pipeline 12*b* on a back side of the entrance part 12*a*, and subsequently, flows through the rise pipeline 12*b* and from a top part 12*c* of the drainage water trap pipeline 12 into a fall pipeline 12*d*.

Herein, the functional part 5 that is provided on the toilet 2, that is, the sanitary washing system functional part 6 and the water supply system functional part 7 will be described. Additionally, the sanitary washing system functional part 6 and the water supply system functional part 7 that are provided in the functional part 5 have structures similar to conventional ones, and hence, such a detailed description of the functional part 5 will be omitted. The sanitary washing system functional part 6 is provided with a (non-illustrated) private part washing device that includes a (non-illustrated) nozzle device that sprays flush water toward a user that sits on the toilet seat 4 (see FIG. 3) and thereby is positioned above the bowl part 11.

In addition, the sanitary washing system functional part 6 is provided with a (non-illustrated) a water storage part that stores flush water that is supplied to a private part washing device, a (non-illustrated) heater that appropriately warms flush water in the water storage part to provide warm water, a (non-illustrated) ventilation fan, a (non-illustrated) deodorization fan, a (non-illustrated) warm air fan, a (non-illustrated) controller that controls operations of such instruments, and the like.

On the other hand, a (non-illustrated) water supply channel of the water supply system functional part 7 is connected to a (non-illustrated) water supply that is a water supply source, on an upstream side, and a water supply channel of the water storage tank 18 (see FIG. 3) on an upstream side is provided with a (non-illustrated) constant flow valve, a (non-illustrated) electromagnetic valve, a (non-illustrated) switching valve that switches between water supply to the water storage tank 18 and water spout to the rim water spout port 14, and the like.

In addition, the water supply system functional part 7 is provided with a (non-illustrated) controller that controls an opening or closing operation of an electromagnetic valve, a switching operation of a switching valve, and a rotation frequency, an operating time, or the like of the pressurization pump 19 (see FIG. 3), and the like.

Furthermore, as illustrated in FIG. 5, the toilet 2 further includes the passing water channel 16. The passing water channel 16 is a flow channel for flush water that is rim-spouted from the rim water spout port 14 and formed from a downstream end of the rim water spout port 14 to a back curved part of the bowl part 11. The passing water channel 16 is formed so as to have a U-shaped cross section of a flow channel that is surrounded by an inner peripheral surface 24 of the rim part 10, the shelf surface 9 that is formed below the inner peripheral surface 24 of the rim part 10, and an overhung part 25 that is formed above the inner peripheral surface 24 of the rim part 10.

Additionally, although a configuration of a so-called hybrid type flush toilet bowl that supplies flush water in the water storage tank 18 by utilizing a water supply pressure of a water supply for rim water spout from the rim water spout port 14 and controlling the pressurization pump 19 for jet water spout from the jet water spout port 17 (see FIG. 3 for both of them) has been described in the flush toilet bowl 1 according to the present embodiment, this is not limiting and another configuration is also applicable.

Another configuration is, for example, a configuration to switch a valve for flush water that is directly supplied from only a water supply and thereby switch between rim water spout from the rim water spout port 14 and jet water spout from the jet water spout port 17, a configuration to switch only a pump for flush water in a water storage tank and thereby switch between rim water spout from the rim water spout port 14 and jet water spout from the jet water spout port 17, or the like.

Rim Water Spout Part

Figure 6A:
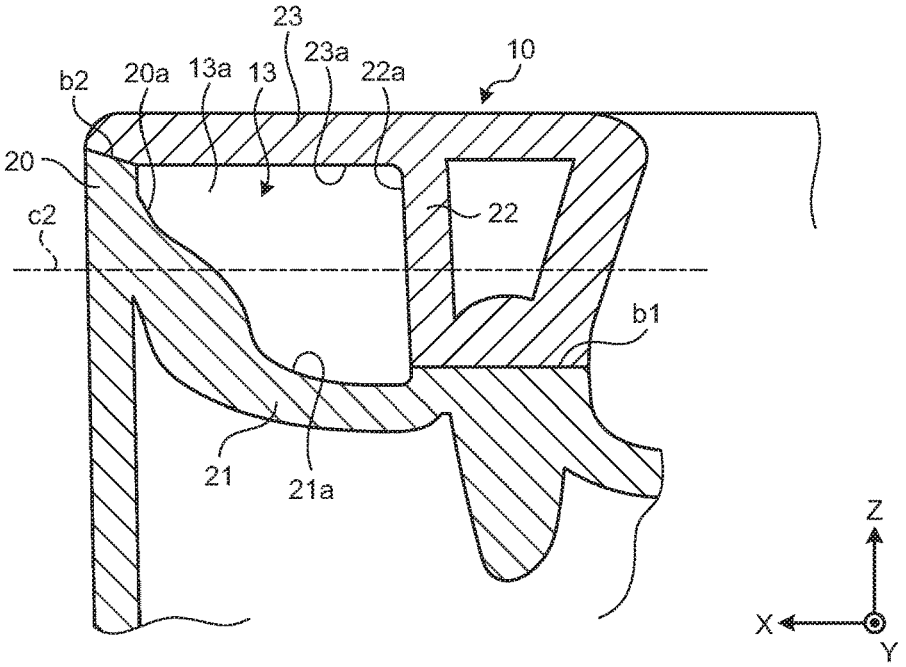
FIG. 6A is a cross-sectional view along A-A in FIG. 5.
Figure 6B:
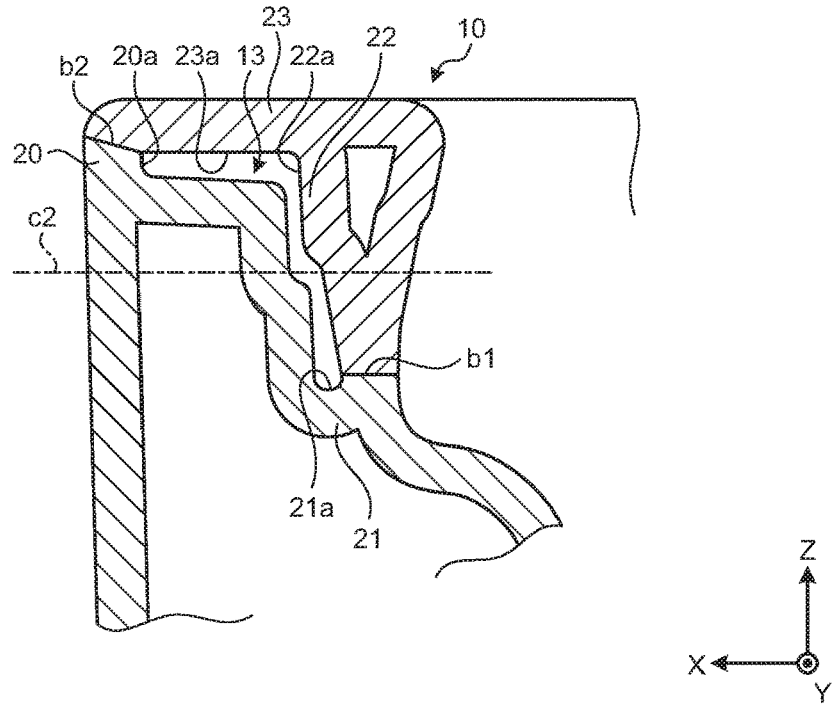
FIG. 6B is a cross-sectional view along B-B in FIG. 5.
Figure 6C:
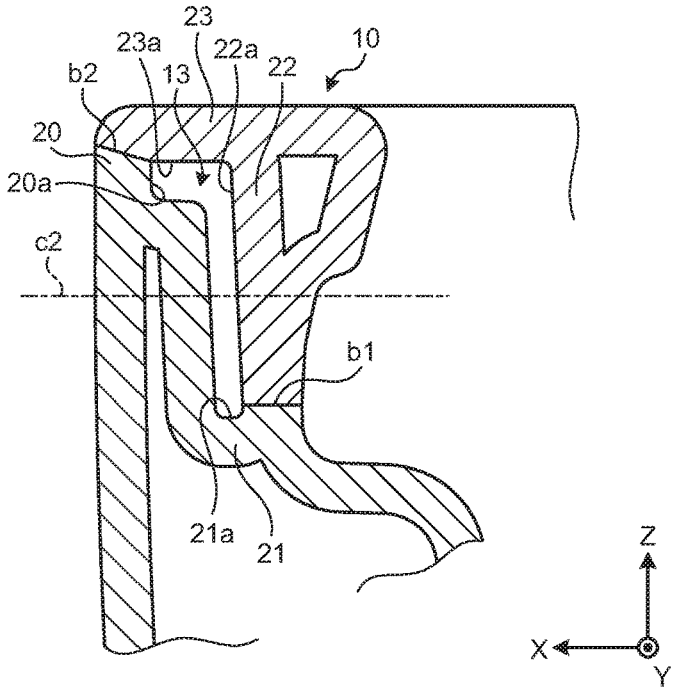
FIG. 6C is a cross-sectional view along C-C in FIG. 5.
Figure 6D:
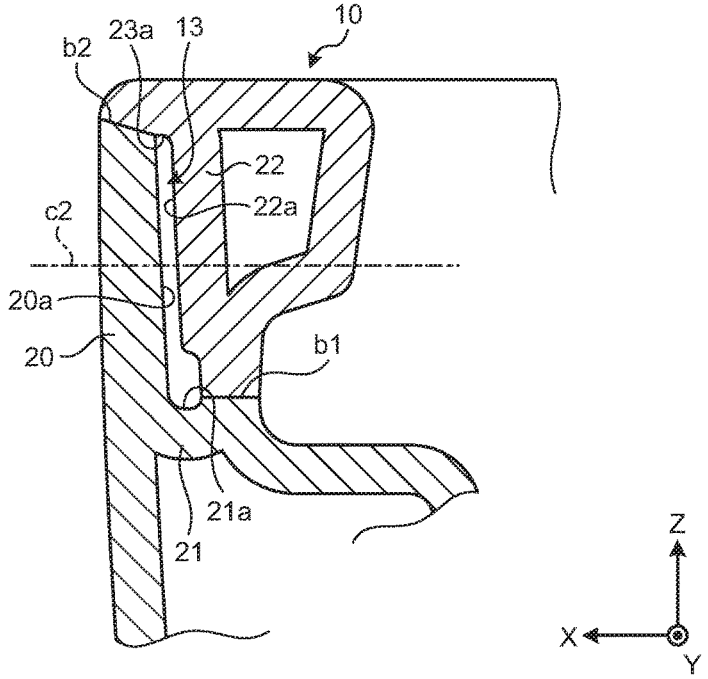
FIG. 6D is a cross-sectional view along D-D in FIG. 5.
Figure 6E:
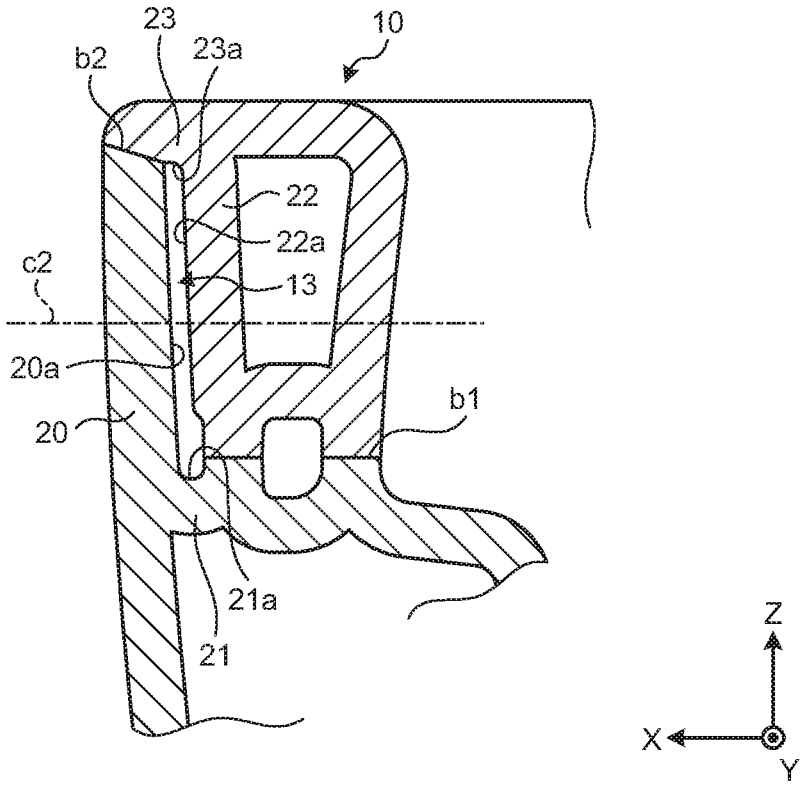
FIG. 6E is a cross-sectional view along E-E in FIG. 5.

Next, a detail of the rim water spout part 30 (the rim water guide channel 13 and the rim water spout port 14) will be described with reference to FIG. 4 to FIG. 6E. FIG. 6A to FIG. 6E illustrate five cross sections of a flow channel from an upstream side to a downstream side of the rim water guide channel 13. FIG. 6A is a cross-sectional view along A-A in FIG. 5. FIG. 6B is a cross-sectional view along B-B in FIG. 5. FIG. 6C is a cross-sectional view along C-C in FIG. 5. FIG. 6D is a cross-sectional view along D-D in FIG. 5. FIG. 6E is a cross-sectional view along E-E in FIG. 5.

As illustrated in FIG. 4 and FIG. 5, the rim water guide channel 13 includes the entrance part 13*a* that is connected to the water guide pipe 15 via the rim nozzle 40, an outer part 13*b* that extends forward (in a negative direction of a Y-axis) from the entrance part 13*a* inside the rim part 10, a bending part 13*c* that bends from a downstream end of the outer part 13*b* to an inside that is a side toward a center of the bowl part 11, and an inner part 13*d* that extends backward (in a positive direction of the Y-axis) from the bending part 13*c* to the rim water spout port 14.

As illustrated in FIG. 6A, the outer part 13*b* (see FIG. 5) of the rim water guide channel 13 includes an outer wall part 20 outside the rim part 10 (in a positive direction of an X-axis), a lower wall part 21 that is integrally formed inward (in a negative direction of the X-axis) from a lower end of the outer wall part 20, an inner wall part 22 that is opposite to the outer wall part 20 in a horizontal direction and has a lower end that is bonded to an upper end of the lower wall part 21, and an upper wall part 23 that is formed integrally with an upper end of the inner wall part 22 and bonded to an upper end of the outer wall part 20.

Bonding surfaces b1 of an upper end surface of the lower wall part 21 and a lower end surface of the inner wall part 22 in the outer part 13*b* of the rim water guide channel 13 form substantially horizontal surfaces. Furthermore, bonding surfaces b2 of an upper surface of the outer wall part 20 and the upper wall part 23 in the rim water guide channel 13 form inclined surfaces that are inclined with respect to the bonding surfaces b1 that are substantially horizontal surfaces. Additionally, a "substantially horizontal surface" includes not only a completely horizontal surface but also a horizontal surface enough for an upper end surface of the lower wall part 21 and a lower end surface of the inner wall part 22, that is, both of the bonding surfaces b1 to be capable of being displaced from each other in a horizontal direction (a direction of an X-axis).

Thereby, for example, in a case where the bonding surface b1 on a lower end of the inner wall part 22 in the rim water guide channel 13 is bonded to the bonding surface b1 on an upper end of the lower wall part 21 therein at a time of manufacturing of the flush toilet bowl 1 according to the present embodiment and simultaneously the bonding surface b2 of the upper wall part 23 in the rim water guide channel 13 is bonded to the bonding surface b2 on an upper end of the outer wall part 20 therein, the bonding surface b2 of the outer wall part 20 and the bonding surface b2 of the upper wall part 23 that form inclined surfaces that are both inclined with respect to a horizontal surface previously contact each other even in a case where the bonding surfaces b1 that form horizontal surfaces are displaced from each other in a horizontal direction due to a manufacturing error or the like.

Accordingly, it is possible to prevent cross sections A to E (see FIG. 5) of a flow channel from the outer part 13*b* to the inner part 13*d* in the rim water guide channel 13 from being completely lost by a displacement between both of the bonding surfaces b1 and it is possible to secure a water guide region of the rim water guide channel 13 over a whole region of the rim water guide channel 13.

As illustrated in FIG. 6A to FIG. 6B, an outer side, a lower side, an inner side, and an upper side of the rim water guide channel 13 are defined by a wall surface 20*a* of the outer wall part 20, a wall surface 21*a* of the lower wall part 21, a wall surface 22*a* of the inner wall part 22, and a wall surface 23*a* of the upper wall part 23, respectively.

FIG. 6A is a cross-sectional view near the entrance part 13*a* that is an upstream side of the rim water guide channel 13 (see FIG. 5). As illustrated in FIG. 6A, the rim water guide channel 13 has, near the entrance part 13*a*, a cross-sectional shape that is formed by the wall surface 20*a* of the outer wall part 20 that is inclined downward toward an inside (in a negative direction of an X-axis), the wall surface 21*a* of the lower wall part 21 that is gently inclined downward and toward an inside with respect to the wall surface 20*a*, the wall surface 22*a* of the inner wall part 22 that extends in upward and downward directions (directions of a Z-axis), and the wall surface 23*a* of the upper wall part 23 that extends in left and right directions (directions of an X-axis).

FIG. 6B is a cross-sectional view on a nearest downstream side of the entrance part 13*a* of the rim water guide channel 13 (see FIG. 5). As illustrated in FIG. 6B, an elongate hole that is longer in transverse directions, that is, left and right directions (directions of an X-axis), is formed on an upper part of the rim water guide channel 13 by an upper end part of the wall surface 20*a* of the outer wall part 20, an upper end part of the wall surface 22*a* of the inner wall part 22, and the wall surface 23*a* of the upper wall part 23.

Furthermore, an elongate hole that is continuous with an elongate hole in transverse directions and longer in longitudinal directions, that is, upward and downward directions (directions of a Z-axis), is formed below the elongate hole in transverse directions for the rim water guide channel 13 by the wall surface 20*a* of the outer wall part 20, the wall surface 21*a* of the lower wall part 21, and the wall surface 22*a* of the inner wall part 22.

Specifically, the rim water guide channel 13 is formed into a cross-sectional shape with an inversed-L-shape where an elongate hole in transverse directions and an elongate hole in longitudinal directions are combined. Accordingly, the rim water guide channel 13 is formed into a cross-sectional shape with a hook shape on an upper side with respect to a center (a center line) c2 of the rim part 10 in upward and downward directions and formed into a cross-sectional shape with a liner shape on a lower side with respect to the center line c2. That is, a cross-sectional area of a lower half part of the rim part 10 in upward and downward directions is less than a cross-sectional area of an upper half part thereof, on a nearest downstream side of the entrance part 13*a* (an upstream side in a whole of the rim water guide channel 13) in the rim water guide channel 13.

FIG. 6C is a cross-sectional view near a center of the rim water guide channel 13 in a forward and backward directions (see FIG. 5). As illustrated in FIG. 6C, an elongate hole that is longer in transverse directions, that is, leftward and rightward directions (directions of an X-axis) is formed on an upper part of the rim water guide channel 13 by an upper end part of the wall surface 20*a* of the outer wall part 20, an upper end part of the wall surface 22*a* of the inner wall part 22, and the wall surface 23*a* of the upper wall part 23.

Specifically, the rim water guide channel 13 is also formed into a cross-sectional shape with an inversed-L-shape where an elongate hole in transverse directions and an elongate hole in longitudinal directions are combined, near a center in forward and backward directions. Accordingly, the rim water guide channel 13 is formed into a cross-sectional shape with a hook shape on an upper side with respect to a center line c2 of the rim part 10 in upward and downward directions and formed into a cross-sectional shape with a linear shape on a lower side with respect to the center line c2. That is, a cross-sectional area of a lower half part of the rim part 10 in upward and downward directions is less than a cross-sectional area of an upper half part thereof, on a nearest downstream side of the entrance part 13*a* (an upstream side in a whole of the rim water guide channel 13) in the rim water guide channel 13.

FIG. 6D is a cross-sectional view on a downstream side with respect to a center of the rim water guide channel 13 in forward and backward directions (see FIG. 5). As illustrated in FIG. 6D, the rim water guide channel 13 is formed into a cross-sectional shape with an elongate hole shape in longitudinal directions (directions of a Z-axis) by the wall surface 20*a* of the outer wall part 20 that is a longer side, the wall surface 21*a* of the lower wall part 21 that is a shorter side, the wall surface 22*a* of the inner wall part 22 that is a longer side that is opposite to the wall surface 20*a*, and the wall surface 23*a* of the upper wall part 23 that is a shorter side that is opposite to the wall surface 21*a*.

FIG. 6E is a cross-sectional view on a nearest upstream side of the bending part 13*c* of the rim water guide channel 13 (see FIG. 5). As illustrated in FIG. 6E, the rim water guide channel 13 is formed into a cross-sectional shape with an elongate hole shape in longitudinal directions (directions of a Z-axis) by the wall surface 20*a* of the outer wall part 20 that is a longer side, the wall surface 21*a* of the lower wall part 21 that is a shorter side, the wall surface 22*a* of the inner wall part 22 that is a longer side that is opposite to the wall surface 20*a*, and the wall surface 23*a* of the upper wall part 23 that is a shorter side that is opposite to the wall surface 21*a*.

That is, an upper space where flush water is flown therein on a nearest downstream side of the entrance part 13*a* is formed in the rim water guide channel 13, and formed so as to be reduced in such a manner that a width of the upper space in left and right directions is reduced with approaching a downstream side.

Herein, as the rim water spout port 14 is formed on a front part of the bowl part 11, that is, in the front side region F1 (see FIG. 4) like the flush toilet bowl 1 according to the present embodiment, a total length of the rim water guide channel 13 is increased and an amount of air that accumulates in the rim water guide channel 13 is increased as compared with a case where a water guide channel is short.

Accordingly, in a case where rim water spout is executed, a diameter of the rim water spout port 14 is less than that of the rim water guide channel 13 and the rim water spout port 14 executes rim water spout backward, so that the bending part 13*c* is formed in the rim water guide channel 13, and hence, a mass of air and flush water are simultaneously spouted from the rim water spout port 14. Furthermore, air in the rim water guide channel 13 frequently accumulates on an upper part of the rim water guide channel 13, and hence, is not readily agitated by flush water. Accordingly, a mass of air is directly spouted from the rim water spout port 14. Thus, abnormal noise that is caused by air may be generated at a time of rim water spout.

According to an embodiment as described above, the rim water guide channel 13 is formed in such a manner that a cross-sectional area of a lower half part in upward and downward directions is less than a cross-sectional area of a upper half part as illustrated in FIG. 6B and FIG. 6C, so that flush water that is guided by the rim water guide channel 13 is readily flown into an upper part in the rim water guide channel 13 and air that accumulates on an upper part in the rim water guide channel 13 is agitated by flowing flush water. Thereby, air in the rim water guide channel 13 is finely fractionized, so that it is possible to suppress abnormal noise that is caused by air at a time of spout of flush water from the rim water spout port 14 and it is possible to improve quietness.

In particular, even in a case where the rim water spout port 14 is arranged in the front side region F1 of the bowl part 11 for improvement of a design or a swirling property of flush water, it is possible to suppress abnormal noise that is caused by air and it is possible to improve quietness.

Furthermore, the rim water guide channel 13 is formed into a shape (an inversed-L-shape) where a cross-sectional shape thereof in upward and downward directions is provided by combining an elongate hole in longitudinal directions and an elongate hole in transverse directions, and hence, it is possible to readily form the rim water guide channel 13 in such a manner that a cross-sectional area of a lower half part is less than a cross-sectional area of an upper half part.

Additionally, although an embodiment as described above provides a cross-sectional shape where an elongate hole in longitudinal directions and an elongate hole in transverse directions are combined so as to provide an inversed-L-shape, this is not limiting and various cross-sectional shapes such as an inversed triangular shape may be provided. Furthermore, in a case where an elongate hole in longitudinal directions and an elongate hole in transverse directions are combined, various cross-sectional shapes such as, for example, a T-shape or a cross shape with a transverse line being on an upper side with respect to a center in upward and downward directions may be provided. In short, any shape may be allowed, as long as a cross-sectional shape of a lower half part in upward and downward directions is less than a cross-sectional shape of an upper half part.

Furthermore, according to an embodiment as described above, the rim water guide channel 13 includes the outer part 13*b*, the bending part 13*c*, and the inner part 13*d* and the rim water spout port 14 is formed on a terminal end of the inner part 13*d* and rim-spouts flush water backward, so that it is possible to reduce a volume of the rim water guide channel 13 as compared with a case the rim water guide channel 13 passes through a front end of the bowl part 11, although the rim water spout port 14 is formed in the front side region F1 of the bowl part 11. Accordingly, it is possible to reduce an amount of air that accumulates in the rim water guide channel 13 and it is possible to further suppress abnormal noise that is caused by air.

Additionally, although a mass of air that accumulates in the rim water guide channel 13 is separated at the bending part 13*c* where its flow (an interface with flush water) is readily destabilized to readily generate abnormal noise, air that accumulates on an upper part in the rim water guide channel 13 is agitated by flush water before reaching the bending part 13*c* as described above, and hence, it is possible to suppress abnormal noise that is caused by air.

Furthermore, a guide part 50 (see FIG. 8A, FIG. 8B, and FIG. 8C) is provided on the entrance part 13*a* in the rim water guide channel 13. The guide part 50 is a surface (where a guide part will be referred to as a "guide surface" below) that separates the entrance part 13*a* and an upper space in the rim water guide channel 13, is provided in such a manner that flush water that is spouted from the rim nozzle 40 (see FIG. 4) collides therewith, and collides with flush water to cause the flush water to flow into the upper space. Additionally, a flow of flush water after flowing into an upper space due to the guide surface 50 will be described later by using FIG. 8A, FIG. 8B, and FIG. 8C.

According to such a configuration, flush water is flown into an upper part in the rim water guide channel 13 more readily and air that accumulates on an upper part in the rim water guide channel 13 is agitated more reliably, so that it is possible to further suppress abnormal noise that is caused by air.

By returning to FIG. 4 and FIG. 5, the rim water spout port 14 is formed on a front end of the inner part 13*d* of the rim water guide channel 13. The rim water spout port 14 rim-spouts backward flush water that is guided to the rim water spout channel 13. Flush water that is rim-spouted from the rim water spout port 14 flows through the passing water channel 16 and becomes a swirling flow that flows while swirling on the waste receiving surface 8.

Furthermore, the rim water spout port 14 is formed in such a manner that an upper end of the rim water spout port 14 is positioned on a lower half part of the rim part 10 in upward and downward directions. According to such a configuration, it is possible to reduce a volume of the rim water guide channel 13 just in front of the rim water spout port 14. Accordingly, it is possible to reduce an amount of air that accumulates in the rim water guide channel 13 and it is possible to further suppress abnormal noise that is caused by air.

Additionally, although the rim water spout port 14 is comparatively small so that air is not readily spouted from the rim water spout port 14 and abnormal noise is readily generated, air that accumulates on an upper part in the rim water guide channel 13 is agitated before reaching the bending part 13*c* so that it is possible to suppress abnormal noise that is caused by air.

Furthermore, the rim water spout port 14 may be formed in such a manner that a cross section of an opening of the rim water spout port 14 has a triangular shape with a vertex in an upward direction. According to such a configuration, it is possible to reduce a region of the overhung part 25 (see FIG. 5) that is positioned above the passing water channel 16 (see FIG. 5) on a downstream side of the rim water spout port 14.

Rim Nozzle

Figure 7A:
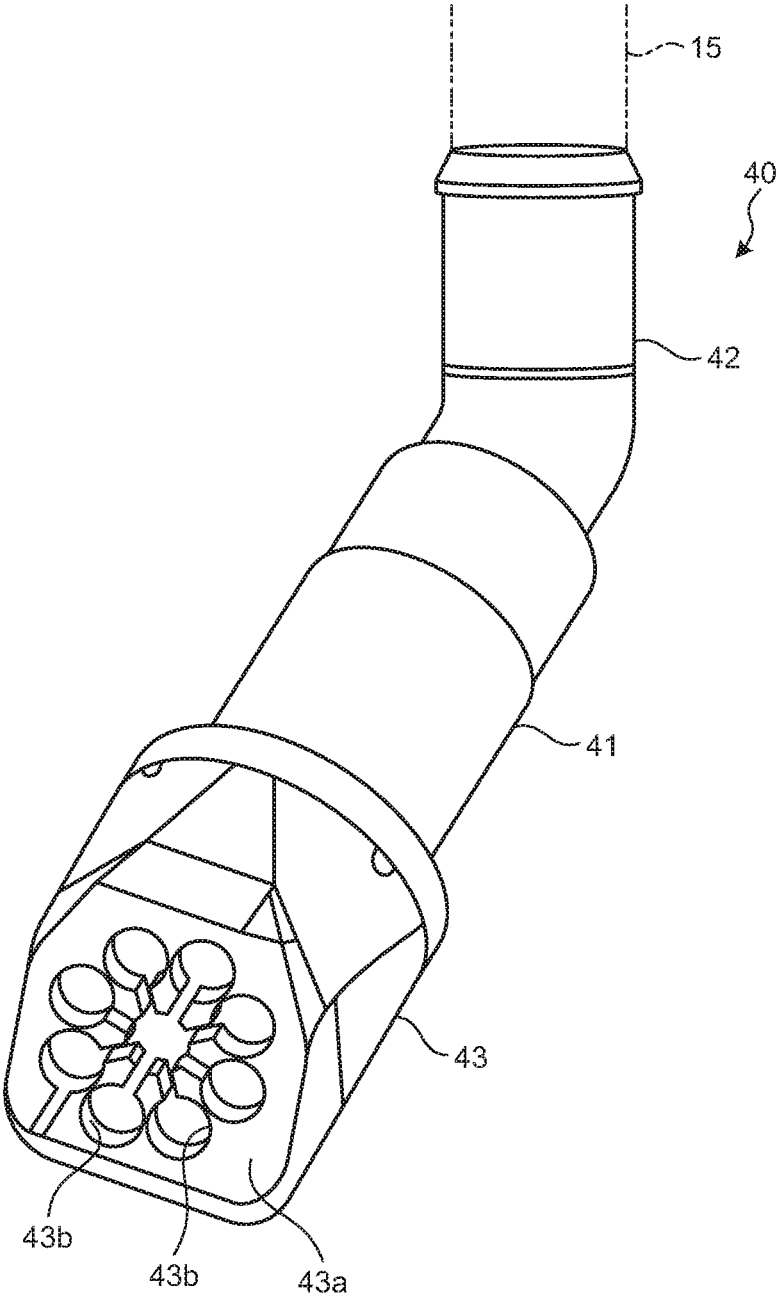
FIG. 7A is a perspective view of a rim nozzle.
Figure 7B:
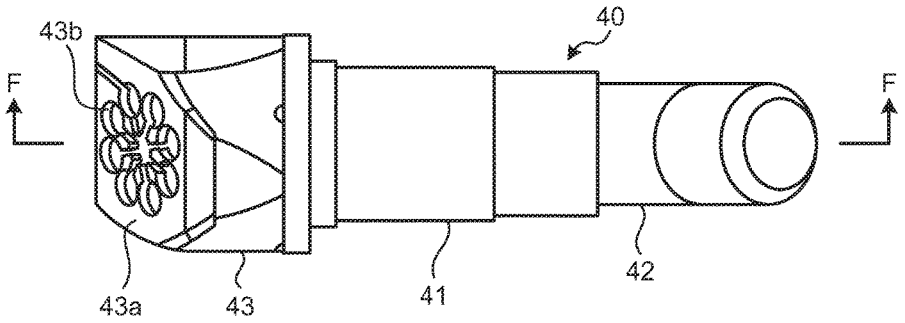
FIG. 7B is a plan view of a rim nozzle.
Figure 7C:
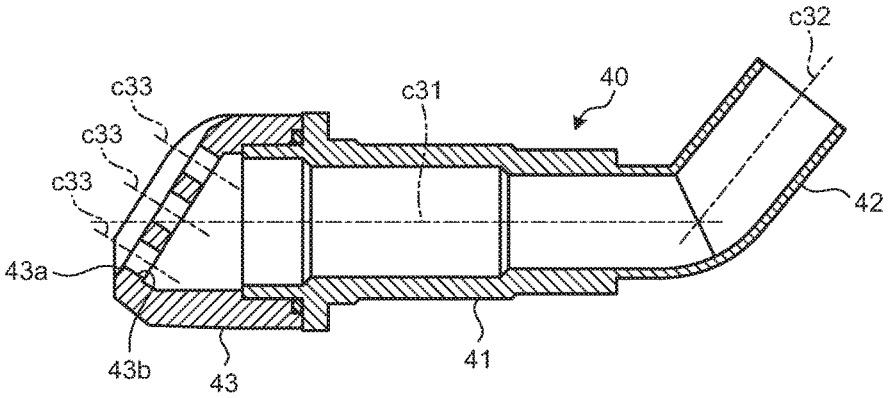
FIG. 7C is a cross-sectional view along F-F in FIG. 7B.
Figure 7D:
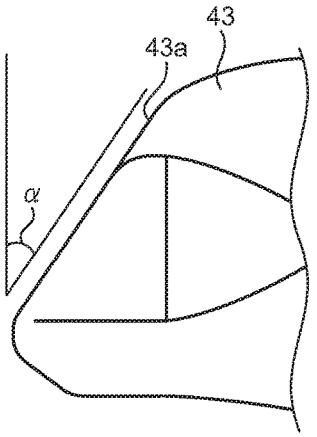
FIG. 7D is an illustration diagram of a spout surface of a rim nozzle.

Next, the rim nozzle 40 will be described with reference to FIG. 7A to FIG. 7D. FIG. 7A is a perspective view of the rim nozzle 40. FIG. 7B is a plan view of the rim nozzle 40. FIG. 7C is a cross-sectional view along F-F in FIG. 7B. FIG. 7D is an illustration diagram of a water spout surface 43*a* of the rim nozzle 40. The rim nozzle 40 spouts flush water that is supplied from a (non-illustrated) water supply that is a flush water source and flows in the water guide pipe 15 (see FIG. 5) into the rim water guide channel 13 (see FIG. 5). The rim nozzle 40 is provided on the entrance part 13*a* of the rim water guide channel 13.

As illustrated in FIG. 7A to FIG. 7C, the rim nozzle. 40 includes a nozzle body 41, a connection part 42, and a water spout part 43. The nozzle body 41 is formed into, for example, a cylindrical shape. The nozzle body 41 forms a passing water channel for flush water in the rim nozzle 40. The connection part 42 is formed into, for example, a cylindrical shape and connected to a front end of the water guide pipe 15 so that the rim nozzle 40 is connected to the water guide pipe 15. The connection part 42 is provided on one end side of the nozzle body 41 and is provided so as to form a space that continuously extends from the nozzle body 41.

As illustrated in FIG. 7C, the connection part 42 has a central axis line c32 that is inclined at a predetermined angle with respect to a central axis (a central axis line) c31 of the nozzle body 41 (a passing water channel in the rim nozzle 40). That is, the connection part 42 is provided on the nozzle body 41 to be inclined at a predetermined angle.

As illustrated in FIG. 7A to FIG. 7C, the water spout part 43 (that is also referred to as a "nozzle cap water spout part") is mounted on the other end side of the nozzle body 41 so as to be coaxial with the central axis line c31 of the nozzle body 41. Additionally, the water spout part 43 is arranged on the entrance part 13*a* (see FIG. 8A) of the rim water guide channel 13 in a state where the rim nozzle 40 is mounted on the rim water guide channel 13.

The water spout part 43 includes the water spout surface 43*a*. The water spout surface 43*a* is a front end surface of the water spout part 43 and spouts flush water toward an inside of the rim water guide channel 13. A plurality of small holes 43*b* that spout flush water is formed on the water spout surface 43*a*. For example, nine small holes 43*b* are formed thereon. In a case where nine small holes 43*b* are formed, for example, one small hole 43*b* (that is also referred to as a "center small hole") is formed at, for example, a center of the water spout surface 43*a* and remaining eight small holes 43*b* are formed around the center small hole 43*b*. Additionally, eight small holes 43*b* around one center small hole 43*b* are formed so as to have, for example, an angle of 45 degrees on a concentric circle of the center small hole 43*b*.

According to such a configuration, flush water is spouted from the plurality of small holes 43*b*, so that the flush water is divided into a plurality of streams in the rim water guide channel 13 (see FIG. 8A), air that accumulates in the rim water guide channel 13 is readily involved with such a plurality of water streams, and air is agitated by the flush water. Thereby, air in the rim water guide channel 13 is finely fractionated. Accordingly, a mass of air is spouted from the rim water spout port 14 at a time of rim water spout, so that it is possible to suppress generation of abnormal noise such as explosive noise of air or mixing noise of air.

Furthermore, a groove may be formed on the water spout surface 43*a* so as to connect a small hole 43*b* with a small hole 43*b*. Furthermore, a groove may be formed, for example, so as to extend radially from a center small hole 43*b* and connect each small hole 43*b* with the center small hole 43*b*. Such a groove is formed, so that it is possible to drain water that is attached to a small hole 43*b* by surface tension thereof outside the water spout part 43 and it is possible to prevent freezing in a cold region or the like.

Herein, the rim nozzle 40 is formed so as to spout flush water upward in the rim water guide channel 13. Specifically, as illustrated in FIG. 7C, a central axis line c33 of the water spout surface 43*a* (a small hole 43*b*) in the rim nozzle 40 is inclined upward with respect to the central axis line c31 of the nozzle body 41. Additionally, "spouting flush water upward" indicates that a main stream of flush water is directed upward.

Thus, according to an embodiment as described above, the rim nozzle 40 is formed so as to spout flush water upward in the rim water guide channel 13, so that flush water that is guided by the rim water guide channel 13 is readily flown into an upper part in the rim water guide channel 13 and air that accumulates on an upper part in the rim water guide channel 13 is agitated by flowing flush water. Thereby, air in the rim water guide channel 13 is finely fractionized, so that it is possible to suppress abnormal noise that is caused by air at a time of spout of flush water from the rim water spout port 14 and it is possible to improve quietness.

In particular, even in a case where the rim water spout port 14 is arranged in the front side region F1 of the bowl part 11 for improvement of a design or a swirling property of flush water, it is possible to suppress abnormal noise that is caused by air and it is possible to improve quietness.

Furthermore, as illustrated in FIG. 7D, the water spout surface 43*a* is a surface inclined at a predetermined angle $\alpha$, so that the central axis line c33 of the water spout surface 43*a* in the rim nozzle 40 is inclined with respect to the central axis line c31 of the nozzle body 41.

According to such a configuration, it is possible to readily form the rim nozzle 40 so as to spout flush water upward. Thereby, flush water that is guided by the rim water guide channel 13 is readily flown into an upper part in the rim water guide channel 13 and air that accumulates on an upper part in the rim water guide channel 13 is agitated by flowing flush water, so that it is possible to suppress abnormal noise that is caused by air.

Furthermore, it is possible to spout flush water upward by only exchanging a single body of the rim nozzle 40. Accordingly, it is possible to improve versatility. Furthermore, it is possible to attain space saving as compared with, for example, a case where the rim nozzle 40 is wholly inclined upward.

State of Flow of Flush Water in Rim Water Guide Channel

Figure 8A:
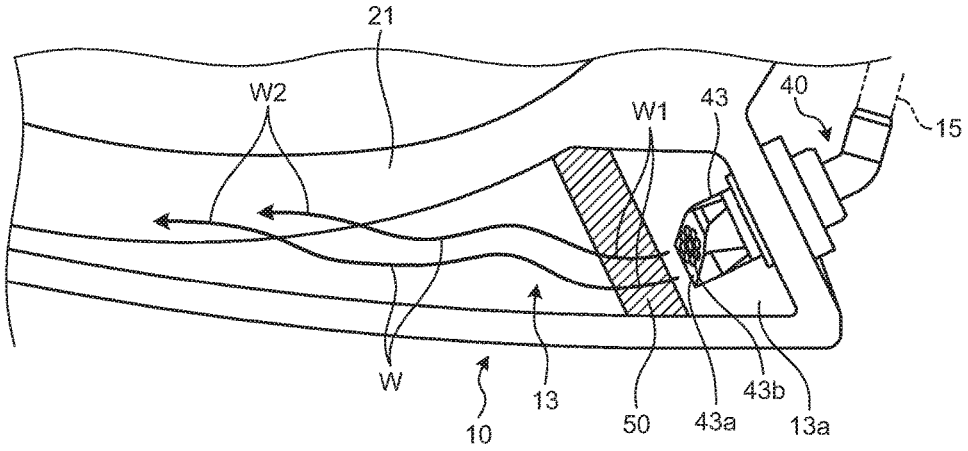
FIG. 8A is a diagram (part 1) illustrating a state of a flow of flush water in a rim water guide channel.
Figure 8B:
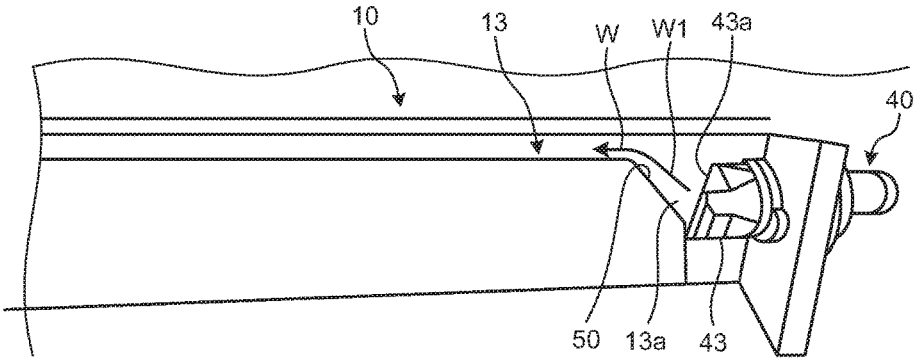
FIG. 8B is a diagram (part 2) illustrating a state of a flow of flush water in a rim water guide channel.
Figure 8C:
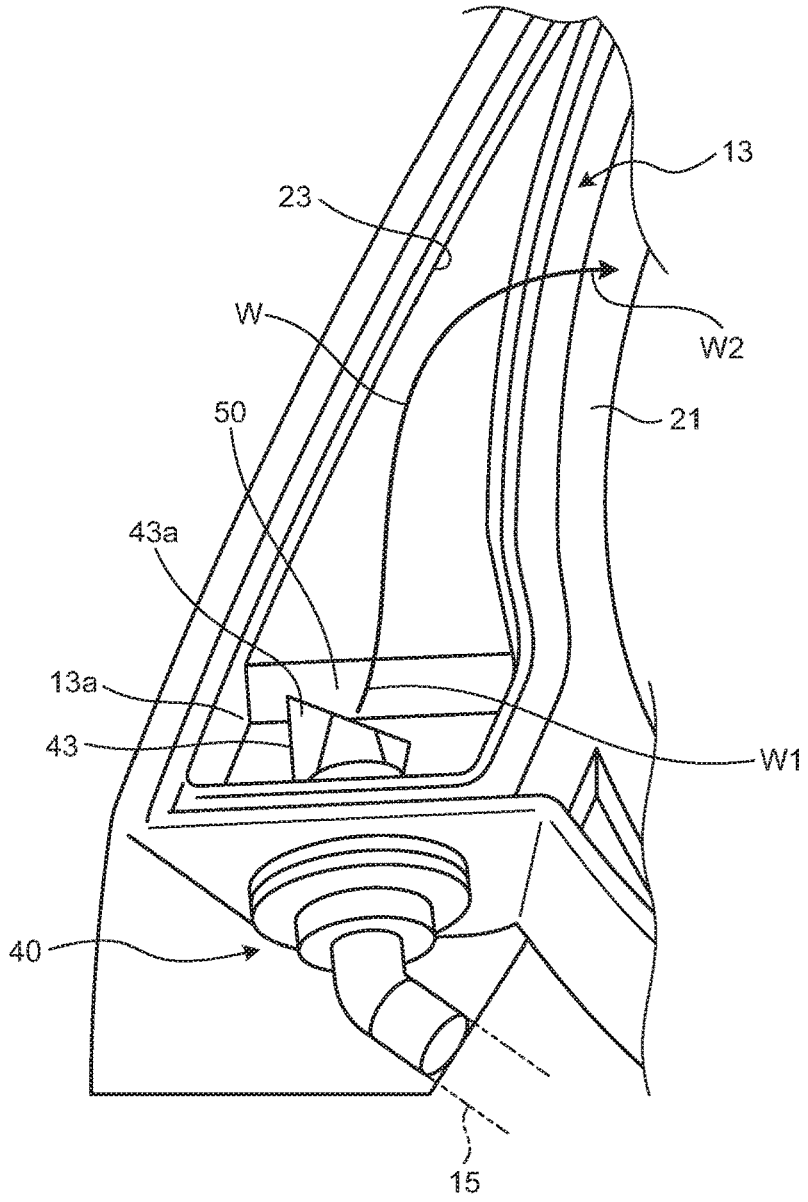
FIG. 8C is a diagram (part 3) illustrating a state of a flow of flush water in a rim water guide channel.

Next, a state of a flow of flush water in the rim water guide channel 13 at a time of rim water spout will be described with reference to FIG. 8A to FIG. 8C. FIG. 8A to FIG. 8C are diagrams illustrating a state of a flow of flush water in the rim water guide channel 13. Additionally, FIG. 8A illustrates a case where the rim water guide channel 13 of the rim part 10 is viewed from a diagonal upside on a right side, FIG. 8B illustrates a case where the rim water guide channel 13 is viewed from a right side, and FIG. 8C illustrates a case where the rim water guide channel 13 is viewed from a diagonal upside on a back side.

As illustrated in FIG. 8A to FIG. 8C, flush water W that is guided from the water guide pipe 15 and spouted from the plurality of small holes 43*b* of the water spout surface 43*a* of the rim nozzle 40 collides with the guide surface (the guide part) 50 on the entrance part 13*a* of the rim water guide channel 13 so as to become a rising flow W1 that rises and flows into an upper space. Flush water that flows into an upper space becomes a falling flow W2 that sequentially falls from the upper space of the rim water guide channel 13 with a width that is gradually reduced in left and right directions, in the middle of flowing to a downstream side while agitating air that accumulates on an upper part in the rim water guide channel 13, and flows so as to fall onto the lower wall part 21 of the rim water guide channel 13.

That is, flush water in the rim water guide channel 13 rises immediately after being spouted from the rim nozzle 40, flows through an upper part in the rim water guide channel 13 to agitate air, and flows to a downstream side so as to fall sequentially. Flush water is spouted (rim-spouted) from the rim water spout port 14 (see FIG. 5) on a downstream side of the rim water guide channel 13.

Furthermore, as illustrated in FIG. 8A to FIG. 8C, the rim nozzle 40 is formed so as to spout flush water toward a side wall surface (for example, the wall surface 22*a* of the inner wall part 22) of the rim water guide channel 13. According to such a configuration, the rim nozzle 40 is formed so as to spout flush water upward in the rim water guide channel 13 and toward a side wall surface (for example, the wall surface 22*a* of the inner wall part 22) of the rim water guide channel 13, so that flush water that is guided by the rim water guide channel 13 is readily flown into an upper part in the rim water guide channel 13 and it is possible to guide flush water along the side wall surface (for example, the wall surface 22*a* of the inner wall part 22) of the rim water guide channel 13. Thereby, air that accumulates on an upper part in the rim water guide channel 13 is agitated more reliably and it is possible to further suppress abnormal noise that is caused by air.

State of Flush Water and Air in Rim Water Guide Channel

Figure 9A:
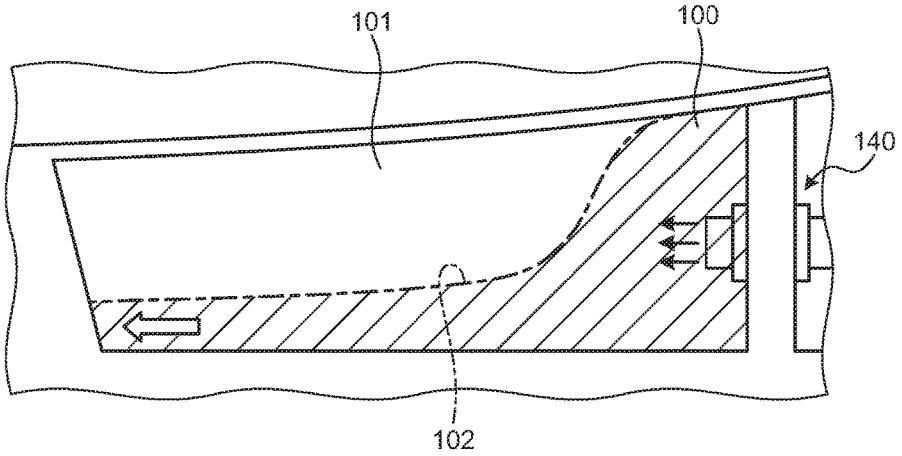
FIG. 9A is a diagram (part 1) illustrating a state of flush water and air in a rim water guide channel in a comparative example.
Figure 9B:
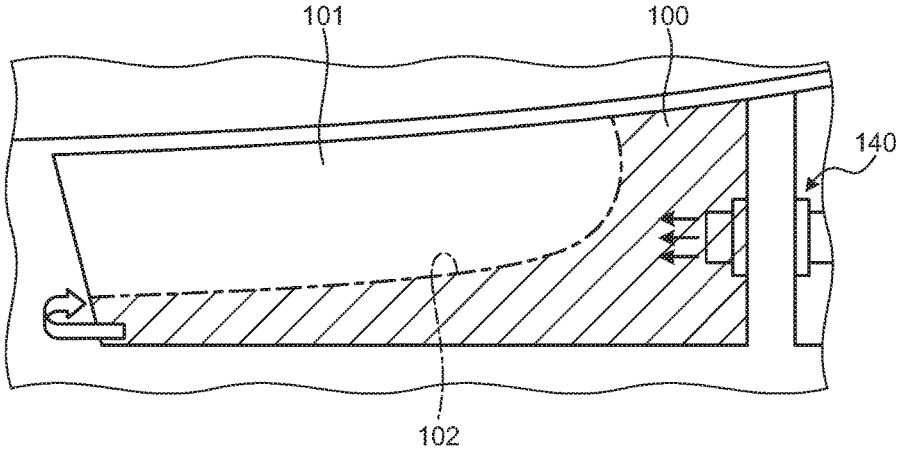
FIG. 9B is a diagram (part 2) illustrating a state of flush water and air in a rim water guide channel in a comparative example.
Figure 10A:
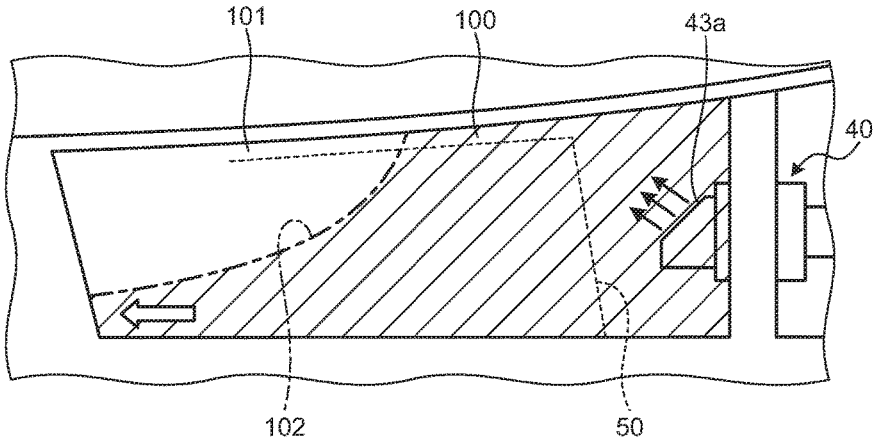
FIG. 10A is a diagram (part 1) illustrating a state of flush water and air in a rim water guide channel in an embodiment.
Figure 10B:
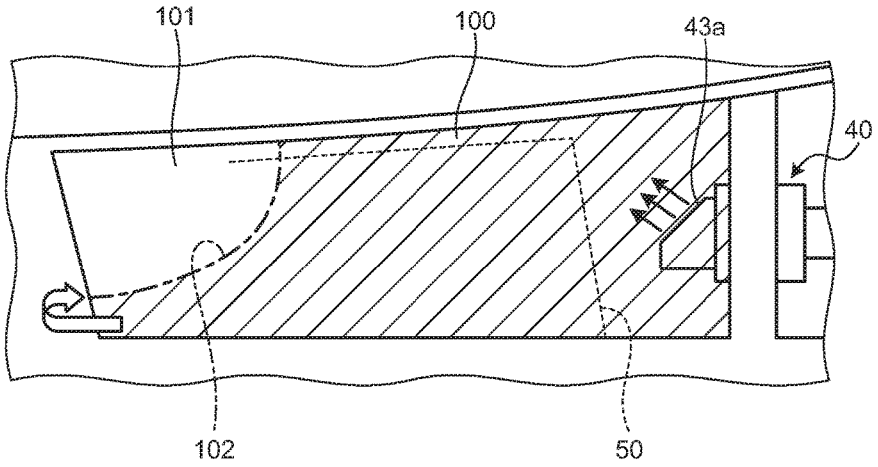
FIG. 10B is a diagram (part 2) illustrating a state of flush water and air in a rim water guide channel in an embodiment.

Next, a state of flush water and air in the rim water guide channel 13 at a time of rim water spout will be described with reference to FIG. 9A to FIG. 10B. FIG. 9A and FIG. 9B are diagrams illustrating a state of flush water and air in the rim water guide channel 13 in a comparative example. FIG. 10A and FIG. 10B are diagrams illustrating a state of flush water and air in the rim water guide channel 13 in an embodiment.

Additionally, FIG. 9A to FIG. 10B schematically illustrate a case where the rim water guide channel 13 is viewed from a right side. Furthermore, FIG. 9A and FIG. 10A illustrate a state of flush water and air at a point of time when flush water reaches the bending part 13*c* (see FIG. 5) of the rim water guide channel 13, and FIG. 9B and FIG. 10B illustrate a state of flush water and air at a point of time when rim water spout from the rim water spout port 14 (see FIG. 5) is started.

As illustrated in FIG. 9A and FIG. 9B, flush water that is spouted from a rim nozzle 140 linearly flows to a downstream side in a comparative example. In such a case, a large amount of air remains on an upstream side to a downstream side, even at a point of time when an interface 102 between flush water 100 and air 101 stagnates and the flush water 100 reaches the bending part 13*c* (see FIG. 5). Accordingly, as rim water spout is started, the flush water 100 and the air 101 are spouted from the rim water spout port 14 (see FIG. 5), so that abnormal noise that is caused by the air 101 is readily generated.

On the other hand, as illustrated in FIG. 10A and FIG. 10B, in an embodiment, flush water that is spouted from the rim nozzle 40 is flown into an upper part of the rim water guide channel 13 (see FIG. 5) by the guide surface (the guide part) 50 and flows through an upper part of the rim water guide channel 13 because a cross-sectional area of a lower half part of the rim water guide channel 13 is less than a cross-sectional area of an upper half part thereof. Furthermore, the rim nozzle 40 spouts flush water upward, so that flush water also flows through an upper part of the rim water guide channel 13.

Flush water that flows through an upper part of the rim water guide channel 13 flows to a downstream side while agitating air that accumulated on an upper part thereof, so that air is finely fractionized and mixed into flush water and air is spouted from the rim water spout port 14 without providing a mass thereof and together with flush water.

Thus, flush water flows through an upper part in the rim water guide channel 13, so that air that accumulates on an upper part in the rim water guide channel 13 is agitated by flowing flush water. Thereby, air in the rim water guide channel 13 is finely fractionized, so that it is possible to suppress abnormal noise that is caused by air at a time of spout of flush water from the rim water spout port 14 and it is possible to improve quietness.

According to an aspect of an embodiment, it is possible to suppress abnormal noise that is caused by air and improve quietness.

Configuration (1) is a flush toilet bowl, including a bowl part that is provided in such a manner that a rim part is formed on an upper edge of a receiving surface with a bowl shape, a rim nozzle that is provided on a rear part of the bowl part and spouts flush water that is supplied from a flush water source, and a rim water spout part that is provided on the rim part, spouts flush water that is spouted from the rim nozzle, toward the receiving surface, and causes flush water to swirl on the receiving surface, wherein the rim water spout part includes a rim water guide channel that is formed inside the rim part and guides flush water that is spouted from the rim nozzle, and a rim water spout port that is formed to be continuous with the rim water guide channel, is formed in a front side region of the bowl part, and spouts flush water that is guided by the rim water guide channel, toward the receiving surface, and the rim nozzle is formed in such a manner that flush water that is spouted from the rim nozzle is spouted upward in the rim water guide channel.

According to Configuration (1), a rim nozzle is formed in such a manner that flush water is spouted upward in a rim water guide channel, so that flush water that is guided by the rim water guide channel is readily flown into an upper part in the rim water guide channel and air that accumulates on the upper part in the rim water guide channel is agitated by flowing flush water. Thereby, air in the rim water guide channel is finely fractionized, so that it is possible to suppress abnormal noise that is caused by air at a time of spout of flush water from a rim water spout port and it is possible to improve quietness.

Configuration (2) is the flush toilet bowl according to Configuration (1), wherein the rim nozzle is formed in such a manner that flush water that is spouted from the rim nozzle is spouted toward a sidewall surface of the rim water guide channel.

According to Configuration (2), a rim nozzle is formed in such a manner that flush water is spouted upward in a rim water guide channel and toward a sidewall surface of the rim water guide channel, so that flush water that is guided by the rim water guide channel is readily flown into an upper part in the rim water guide channel and it is possible to guide flush water along the sidewall surface of the rim water guide channel. Thereby, air that accumulates on an upper part in a rim water guide channel is agitated more reliably, so that it is possible to further suppress abnormal noise that is caused by air.

Configuration (3) is the flush toilet bowl according to Configuration (1) or (2), wherein the rim water guide channel includes a guide part that guides flush water that is spouted from the rim nozzle upward at an entrance part for flush water of the rim water guide channel.

According to Configuration (3), flush water is flown into an upper part in a rim water guide channel more readily and air that accumulates on the upper part in the rim water guide channel is agitated more reliably, so that it is possible to further suppress abnormal noise that is caused by air.

Configuration (4) the a flush toilet bowl according to any one of Configurations (1) to (3), wherein the rim nozzle is provided in such a manner that a central axis of a water spout surface that spouts flush water is inclined upward with respect to a central axis of a water passage for flush water in the rim nozzle.

According to Configuration (4), it is possible to readily form a rim nozzle in such a manner that flush water is spouted upward. Thereby, flush water that is guided by a rim water guide channel is readily flown into an upper part in the rim water guide channel and air that accumulates on the upper part in the rim water guide channel is agitated by flowing flush water, so that it is possible to suppress abnormal noise that is caused by air.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A flush toilet bowl, comprising:

a bowl part that is provided in such a manner that a rim part is formed on an upper edge of a receiving surface with a bowl shape;

a rim nozzle that is provided on a rear part of the bowl part and spouts flush water that is supplied from a flush water source; and a rim water spout part that is provided on the rim part, spouts flush water that is spouted from the rim nozzle, toward the receiving surface, and causes flush water to swirl on the receiving surface, wherein:

the rim water spout part includes:

a rim water guide channel that is formed inside the rim part and guides flush water that is spouted from the rim nozzle; and a rim water spout port that is formed at a downstream end of the rim water guide channel to be continuous with the rim water guide channel, is formed in a front side region of the bowl part, and spouts flush water that is guided by the rim water guide channel, toward the receiving surface, the rim water guide channel is formed as a closed channel to the rim water spout port, and the rim nozzle is composed of another component than that of the rim water guide channel and is formed in such a manner that flush water that is spouted from the rim nozzle is spouted upward with respect to a horizontal direction in the rim water guide channel.

2. The flush toilet bowl according to claim 1, wherein the rim nozzle is formed in such a manner that flush water that is spouted from the rim nozzle is spouted toward a sidewall surface of the rim water guide channel.

3. The flush toilet bowl according to claim 1, wherein the rim water guide channel includes a guide part that guides flush water that is spouted from the rim nozzle upward at an entrance part for flush water of the rim water guide channel.

4. The flush toilet bowl according to claim 1, wherein the rim nozzle is provided in such a manner that a central axis of a water spout surface that spouts flush water is inclined upward with respect to a central axis of a water passage for flush water in the rim nozzle.

* * * * *